US010472932B2

(12) United States Patent
Torrent et al.

(10) Patent No.: US 10,472,932 B2
(45) Date of Patent: Nov. 12, 2019

(54) OVERTENSIONING FASTENING TOOL

(71) Applicant: Safety Design USA Inc., Wichita Falls, TX (US)

(72) Inventors: Felix Antonio Torrent, Las Heras (AR); Jose Ricardo Torrent, Las Heras (AR)

(73) Assignee: Safety Design USA, Inc., Wichita Falls, TX (US)

( * ) Notice: Subject to any disclaimer, the term of this patent is extended or adjusted under 35 U.S.C. 154(b) by 361 days.

(21) Appl. No.: 15/412,707

(22) Filed: Jan. 23, 2017

(65) Prior Publication Data

US 2017/0130563 A1 May 11, 2017

Related U.S. Application Data

(63) Continuation-in-part of application No. 14/520,888, filed on Oct. 22, 2014, now abandoned.

(51) Int. Cl.
*E21B 41/00* (2006.01)
*E21B 23/00* (2006.01)
*E21B 19/12* (2006.01)

(52) U.S. Cl.
CPC ..... *E21B 41/0021* (2013.01); *E21B 19/12* (2013.01); *E21B 23/00* (2013.01)

(58) Field of Classification Search
CPC ..... E21B 19/10; E21B 19/12; E21B 41/0021; E21B 40/00; E21B 19/22; E21B 2034/005; E21B 23/00; B66D 3/02; B66D 3/00; B66B 19/02; B66B 19/00; Y10T 24/3996; Y10T 24/3969; Y10T 24/44308
See application file for complete search history.

(56) References Cited

U.S. PATENT DOCUMENTS 2,780,290 A * 2/1957 Natho ..... E21B 34/10 166/319
3,454,297 A * 7/1969 Turner, Jr. ..... E21B 19/07 24/491
2008/0236838 A1* 10/2008 Smith ..... E21B 33/072 166/373
2009/0260797 A1* 10/2009 Doud ..... E21B 19/10 166/53
2013/0153212 A1* 6/2013 Myers ..... E21B 40/00 166/250.01

* cited by examiner

*Primary Examiner* — George S Gray
(74) *Attorney, Agent, or Firm* — Lee & Hayes, P.C.

(57) ABSTRACT

An overtensioning fastening tool to maintain control of oil and gas equipment and prevent migration upon failure. The overtensioning fastening tool is comprised of one or more flapper components, housed in a primary enclosure, a hydraulic deployment system and/or electric deployment system, housed in a secondary enclosure, a sensor, and a manual activation component. The overtensioning fastening tool is designed to grip and hold equipment and tooling, such as cables.

20 Claims, 20 Drawing Sheets

OVERTENSIONING FASTENING TOOL

This application is a continuation-in-part to U.S. application Ser. No. 14/520,888, filed on Oct. 22, 2014, entitled "Overvoltage Fastening Tool," which claims priority to Argentina Application No. 20130103874, filed on Oct. 24, 2013, both contents of which are incorporated herein by reference.

BACKGROUND

A variety of techniques for well construction and production are utilized in the oil and gas field, depending on the type of formation, the location of the rig, the desired product to be extracted, etc. During formation of the wellbore and subsequent production endeavors, various tools and equipment, such as cables and pumping equipment, may be lost due to equipment failure or human error. Loss of tools and equipment, such as electric submersible pumps secured with cables, into a wellbore can lead to costly "fishing" expeditions, in which tools are used to recover the lost items.

Fishing expeditions can last for multiple days, depending on the item being retrieved and the retrieval process. In some situations, if the well has been sufficiently damaged, a new drilling operation may need to be commenced in a nearby location. Production losses resulting from a fishing expedition and new drilling operations can be incredibly costly and time consuming.

In addition, equipment failure or human error can lead to serious injury and even loss of life. For example, if a cable breaks or becomes unsecured during the reinstallation or removal of an electric submersible pump, this can lead to rapid migration of attached equipment, increasing the likelihood of injury to workers in the surrounding area. Maintaining control of tools and equipment for producing can help avoid costly production loss and prevent human injury.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Figure 1:
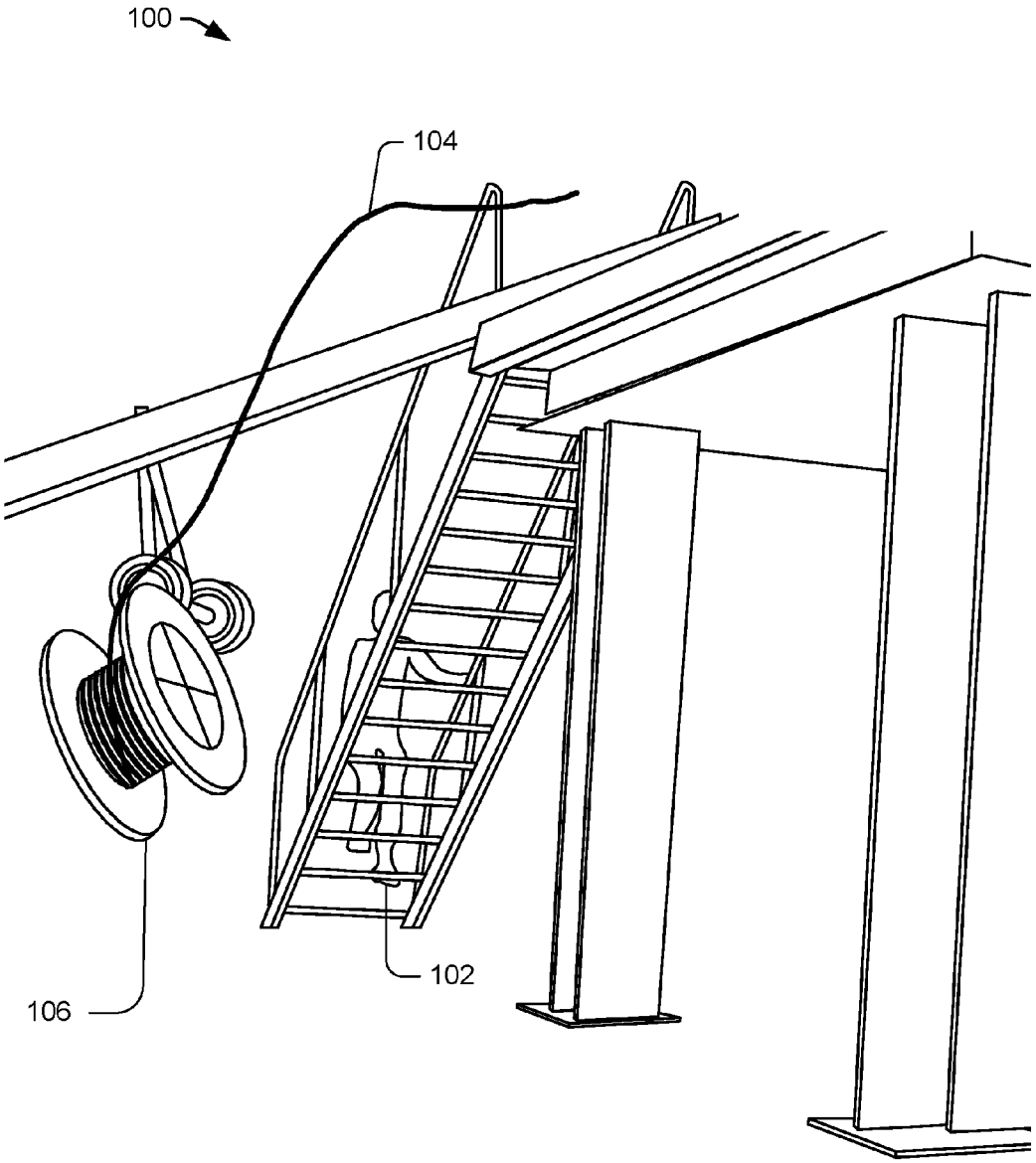
FIG. 1 illustrates an example of a traditional oil and gas rig representing potential safety hazards.

The present disclosure is directed to an overtensioning fastening tool for maintaining safety and control of oil and gas operations. In some cases, an overtensioning fastening tool may be placed at the wellhead of, for instance, an oil and gas rig and implement one or more flapper components, housed in a primary enclosure, designed to grip and hold the cables to prevent the loss of the equipment, or attached tooling, into the wellbore and maintain the safety and integrity of the rig environment. The overtensioning fastening tool may also implement a hydraulic deployment system, electric deployment system, or a combination thereof, housed in a secondary enclosure, designed to activate and maintain control over the flapper components.

The techniques, systems, and materials described herein improve the safety and production efficiency of oil and gas operations. For example, the overtensioning fastening tool described herein may ensure that various production equipment is not lost into the wellbore after an equipment failure or human error. More specifically, materials such as cabling are often utilized in production operations to run production materials into a wellbore and secure production equipment blow the surface. Production equipment is often very heavy, resulting in the cabling being held at a very high tension over an extended period of time. If a cable becomes unstable or experiences a breakage, the attached equipment may be lost into the wellbore. Maintaining control of the equipment and tooling of the rig via the flapper components of the overtensioning fastening tool ensures that costly fishing expeditions are not required.

In addition, the one or more flapper components may also serve to maintain the safety of the rig environment for rig workers and other personnel. For example, if a cable becomes unstable or experiences a breakage as described above, a component attached to the cable may experience rapid migrations throughout the rig area. Preventing rapid migrations of heavy equipment or tooling creates a safer environment and significantly lowers the risk of injury or death.

In some examples, the flapper components may include one or more flapper arms, a flapper plate (also referred to as a clamp), and a flapper joint to ensure uniform movement of the flapper components into a closed position upon activation. The flapper plate is designed to hold cabling, as well as any tubing present, to maintain constant control. The device is designed to hold equipment, such as the cabling and tooling, and apply force to ensure no further migration upon failure. The flapper plate may also include a curvature (also referred to as a fastening component) designed to more securely fit the flapper plate around the exterior of the equipment. The flapper component may also include an additional gripping component that extends from the flapper plate to ensure that smaller interior equipment, such as a cable being run into the wellbore through the well tubing, does not migrate in the event of a larger exterior equipment failure.

In some embodiments, the overtensioning fastening tool may be activated by either a sensor or a manual activation component. The manual activation component includes an activation panel, located on the rig site, more specifically the operator cab, configured to receive a user input. For example, the manual activation component may include an activation button that can be pushed by a rig worker. The sensor is designed to monitor the stability, tension, and balance of the rig equipment and is programmed to detect deviation from a pre-set tension. The pre-set tension may vary according to the production environment, equipment, well depth, and customer preference. Upon detecting the deviation within the tension, the overtensioning fastening tool is activated by the sensor.

In further embodiments, the overtensioning fastening tool implements both an electric deployment system and a hydraulic deployment system. The hydraulic deployment system is configured to operate in conjunction with the sensor and includes a hydraulic cylinder, a check valve, a hose, and one or more hydraulic arms. When the sensor activates the overtensioning fastening tool, the hydraulic deployment system engages. In some examples, engaging the hydraulic deployment system causes the hose to supply enough water to apply a pressure to a hydraulic cylinder shaft of the hydraulic cylinder. The pressure caused by the hydraulic cylinder causes movement of the hydraulic cylinder shaft. The movement of the hydraulic cylinder shaft causes the flapper joints of the overtensioning fastening tool to deploy the flappers into a closed position. For example, the hydraulic cylinder shaft may cause a downward movement of the flappers to mirror the movement of the free-falling cable.

In other examples, the electric deployment system is configured to operate in conjunction with the manual activation component. When the activation button is pressed, the overtensioning fastening tool is activated and an electric valve is opened. Upon opening of the electric valve, gas is released to create a pressure that is applied against an electric valve cylinder. The applied pressure causes the electric valve cylinder to apply a force onto an electric valve arm to deploy attached flapper components to the closed position.

In further examples, the overtensioning fastening tool may implement a wheelguide component. The wheelguide component is configured to operate similarly to the components housed in the main and secondary enclosures of the overtensioning fastening tool. For example, the wheelguide may include one or more sensors designed to monitor tension, balance, and weight of the drilling and production equipment and detect deviations outside of a desired range. Upon detection of a deviation from within the desired range, the wheelguide activates gripping components to apply a force to the rig equipment, such as cabling that rungs through the wheelguide, to maintain control and prevent further migration. The wheelguide may also include a severing component to sever well equipment, such as cabling, to prevent rapid migration presenting a safety hazard.

These and other implementations are described below in more detail with reference to the representative architecture illustrated in the accompanying figures.

FIG. 1 illustrates an example of an oil and gas rig 100 representing potential safety hazards. For example, a rig worker 102 is shown ascending a flight of stairs on the oil and gas rig 100. It is routine for many rig employees to be actively engaged in the operations of the oil and gas rig 100 twenty-four hours a day.

In this embodiment, the oil and gas rig 100 represents a rig in which various cables are attached to well equipment, such as producing equipment. The various cables may be attached to very heavy well equipment within the well hole resulting in high tension on the cables. For example, cable 104 is shown attached to cable spool 106 on one end and a piece of producing equipment (not pictured) on the other end. When the tension on the cable 104 is released, due to either an equipment failure or human error, the cable 104 and attached spool 106 may experience rapid migration in an unpredictable direction as the producing equipment is placed into the well or removed. In the illustrated scenario, the cable spool 106 is directly in line to collide with the rig worker 102. Such a collision could result in serious injury or even death. The overtensioning fastening tool described herein, is designed to maintain control of cables, such as cable 104, employed on a rig during these situations and, thereby, prevent any potential hazardous situation such as the one shown in FIG. 2 and is common in conventional oil and gas rigs.

Figure 2:
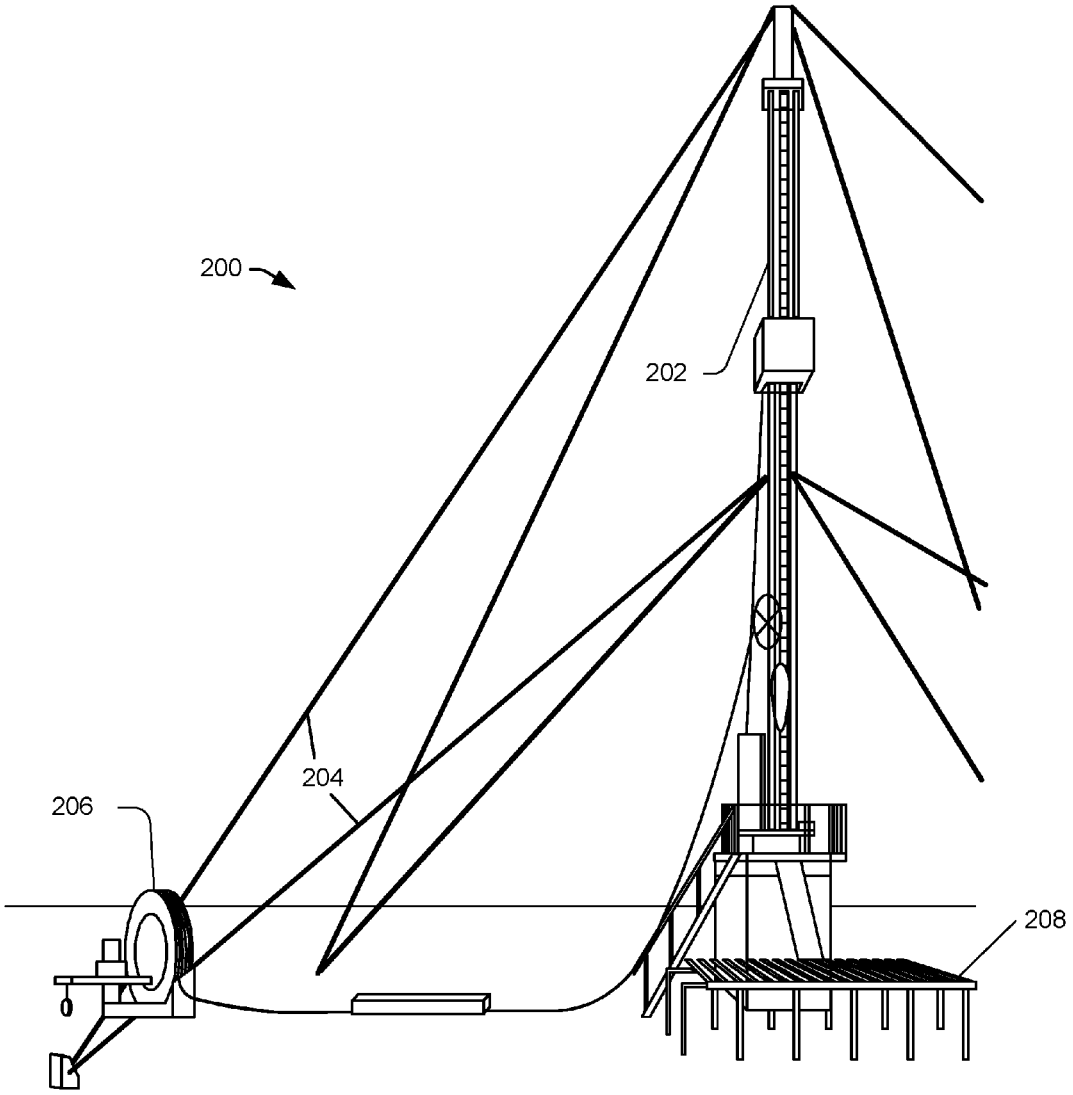
FIG. 2 illustrates another example oil and gas rig implementing an overtensioning fastening tool according to some implementations.
Figure 3:
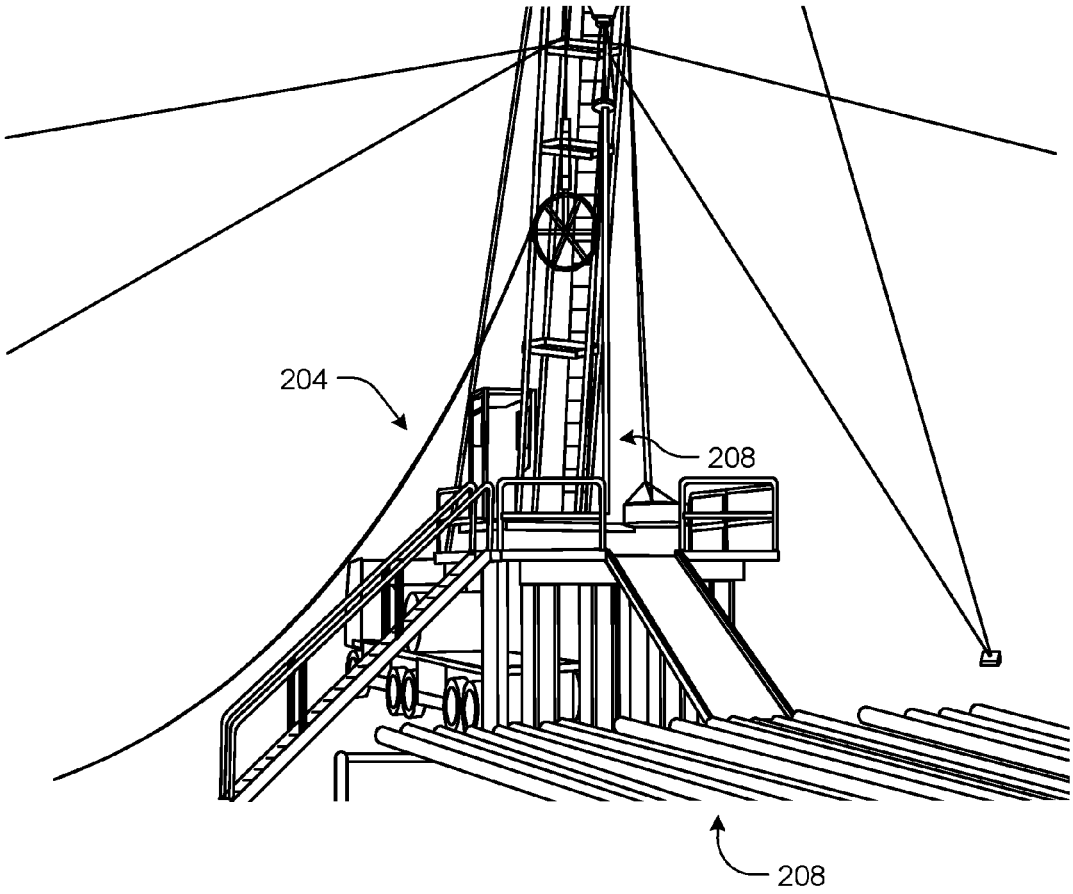
FIG. 3 illustrates another view of the oil and gas rig of FIG. 2.

FIGS. 2 and 3 illustrate an example of an oil and gas rig 200 implementing an overtensioning fastening tool. The oil and gas rig 200 implements various cables that are connected to portions of the oil rig mast 202. For example, the cable 204 is wrapped around cable spool 206 and attached to the oil rig mast 202 at various locations. In this example, the well tubing 208, sometimes referred to as piping or tubing is being removed and placed next to the oil and gas rig 200. The oil and gas rig 200 implements an overtensioning fastening tool (not clearly shown) to maintain control of the well tubing 208 and the various cables, including cable 204, in the event of an equipment failure or human error. The structure and function of the overtensioning fastening tool is described in greater detail below.

Figure 4:
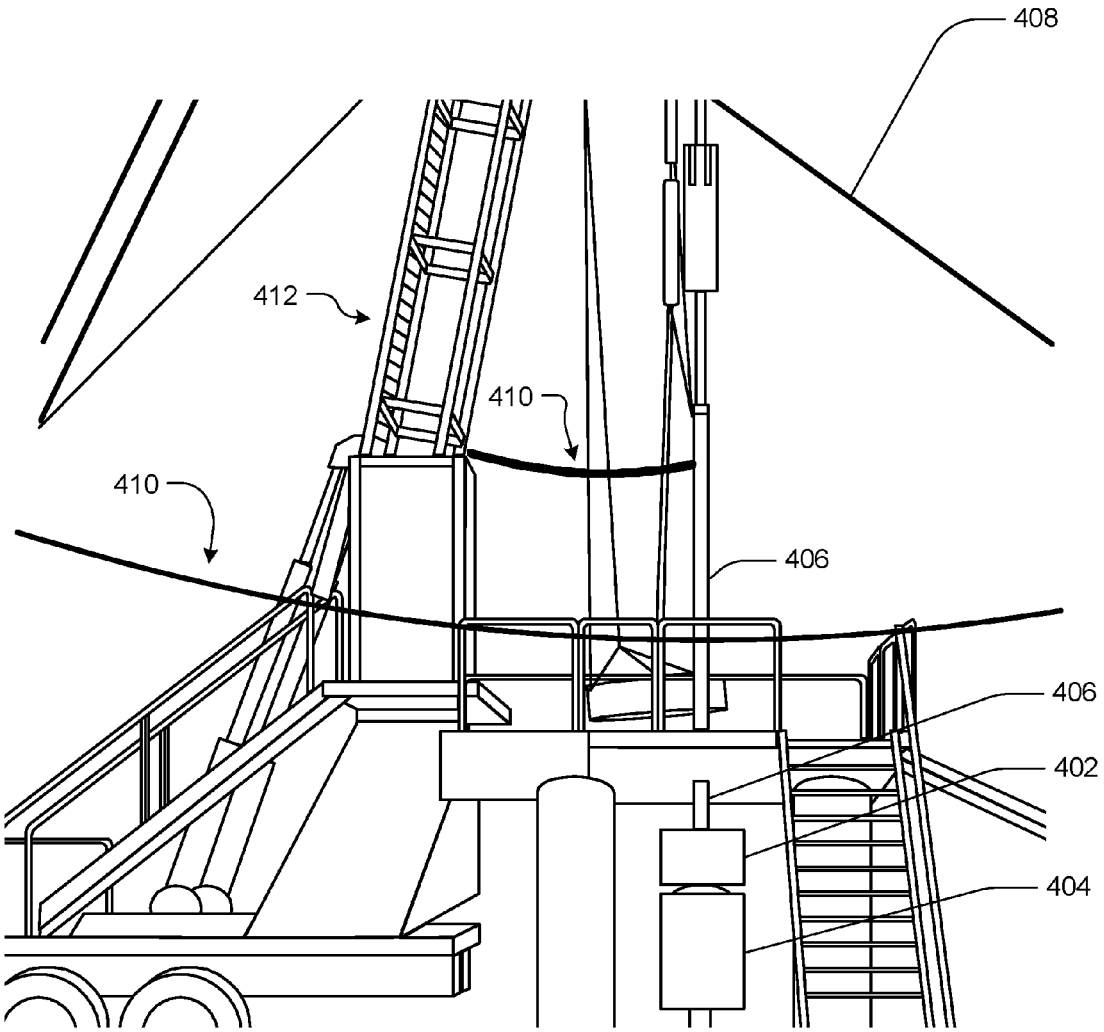
FIG. 4 illustrates another view of the oil and gas rig of FIG. 2.

FIG. 4 illustrates another view of the oil and gas rig 200 of FIG. 2, including a depiction of the overtensioning fastening tool 402. The overtensioning fastening tool 402 is located at the top of the wellhead 404 and has an opening for any well materials, such as production materials, tooling, equipment, and well tubing to run through the device. For example, the opening may allow the illustrated well tubing 406 and cable 408, or an electric submersible pump (not shown), to run through the overtensioning fastening tool 402 into the wellbore. The various components of the overtensioning fastening tool 402, which are described herein, maintain control of the well tubing 406 and cable 408 during operation of the oil and gas rig 200 to prevent loss into the wellbore.

Further, FIG. 4 depicts a minimum angle 410 that should be maintained between the tower 412 and the well. Exceeding the minimum angle 410 may cause the straps (not shown) holding the well tubing 406 in place to snap. In these situations, the well tubing 406 may drop into the well hole damaging any well materials such as production materials, tooling, and/or equipment attached to the cable 408 or, in some instances, even destroying the well itself. Thus, in these situations, the overtensioning fastening tool 402 is configured to grab and/or secure the well tubing 406 and prevent the well tubing 406 from falling into the well.

Figure 5:
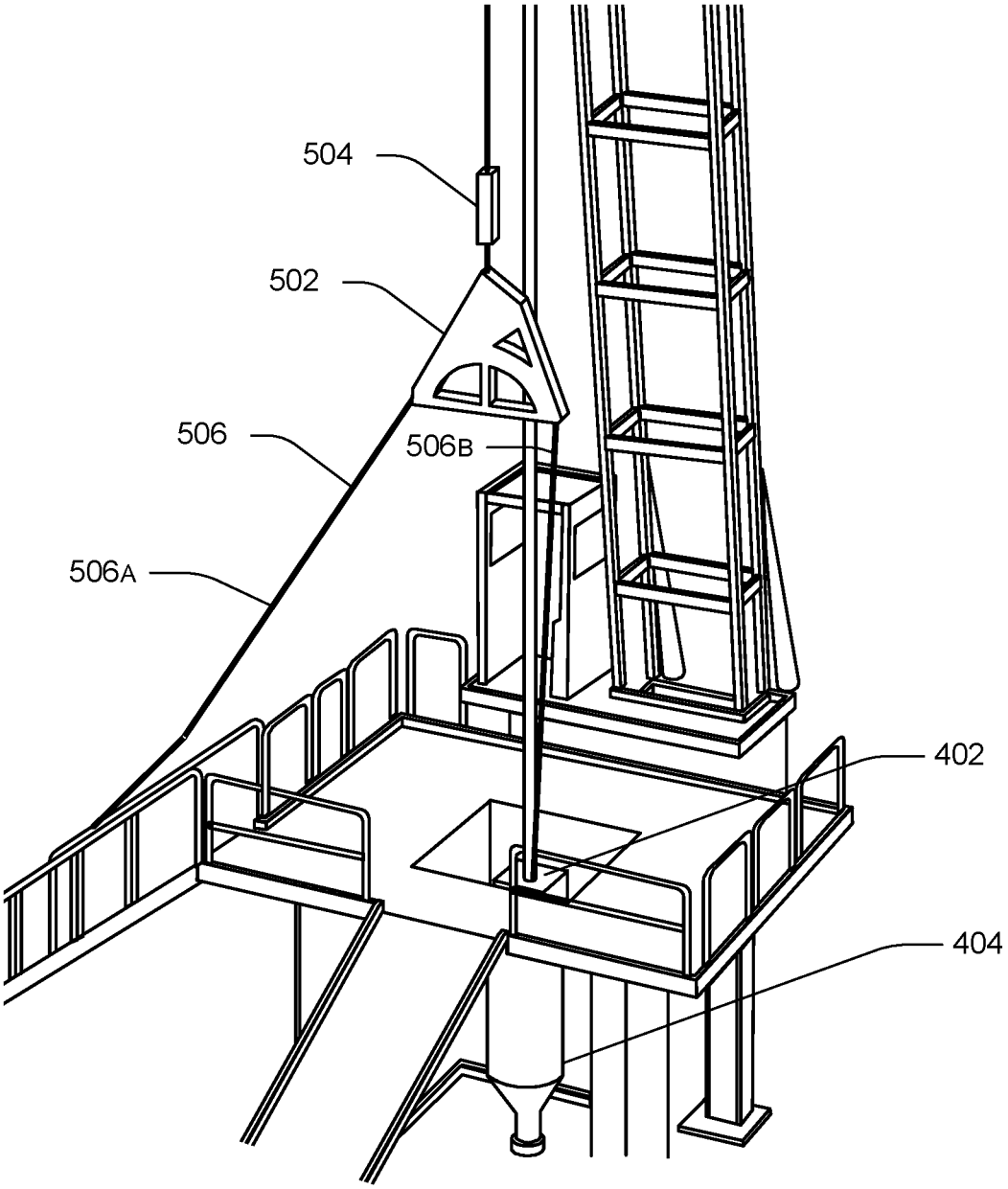
FIG. 5 illustrates another view of the oil and gas rig of FIG. 2.

FIG. 5 illustrates another view of the oil and gas rig 200 of FIG. 2, including a depiction of the wheel guide 502 and sensor 504 that is implemented in conjunction with the overtensioning fastening tool 402. In some examples, the wheel guide 502 operates in a manner similar to the overtensioning fastening tool 402, maintaining control of various cables that are in operation with the oil and gas rig 200.

In some implementations, a cable 506 runs through the wheel guide 502 during the operation of the oil and gas rig 200. In some instances, the cable 506 may be attached to the cable spool 206 (shown in FIG. 2) and may run through the wellhead 404 into the wellbore. The cable 506 may be used to run tooling and production equipment down through the wellbore during producing operations. For example, the cable 506 may be attached to various pumping equipment, such as a submersible pump, below the surface of the well. The cable 506 may be held at very high tensions throughout operations, resulting in a high risk of failure. In the event of failure of cable 506, a fishing expedition may be required to retrieve lost cable, along with any tooling or equipment attached to or being held by cable 506, that may be released into the wellbore upon failure.

In some implementations, the wheel guide 502 includes one or more sensors configured to monitor the tension, weight stability, and balance in cable 506. The one sensors are configured to detect a change in weight stability, an imbalance, and/or change in cable tension. These events are often associated with an equipment failure or human error. For example, if the cable 506 breaks, is severed, or is accidentally released by an operator, an imbalance and/or change in cable tension may occur. Upon sensing this imbalance and/or change in cable tension, the one or more sensors of wheel guide 502. The wheel guide 502, once activated, engages one or more gripping mechanisms designed to hold the cable 506 in place and prevent any additional loss of cable or tooling/equipment into the wellbore. For example, the wheelguide 502 may implement flapper components such as those of the overtensioning fastening tool In further examples, the oil and gas rig 200 also implements a sensor 504 configured to operate in conjunction with the overtensioning fastening tool 402. In some embodiments, the sensor 504 is configured to detect the tension of cable 506. The sensor 504 is programmed with a pre-set tension range, or tension threshold value at which cable 506 should remain. The sensor 504 monitors the tension of cable 506 and is configured to detect changes in the tension of cable 504 that deviate more than a certain amount from the pre-set tension. Deviations from the pre-set tension may indicate an equipment failure or human error resulting in potentially hazardous conditions to the operation of the oil and gas rig 200. In response to detecting a deviation, the sensor 504 may activate the overtensioning fastening tool 402 and/or the wheel guide 502 to ensure control of the cable 506 is maintained at the wellhead to prevent the cable and/or attached equipment from falling into the wellbore.

Figure 6:
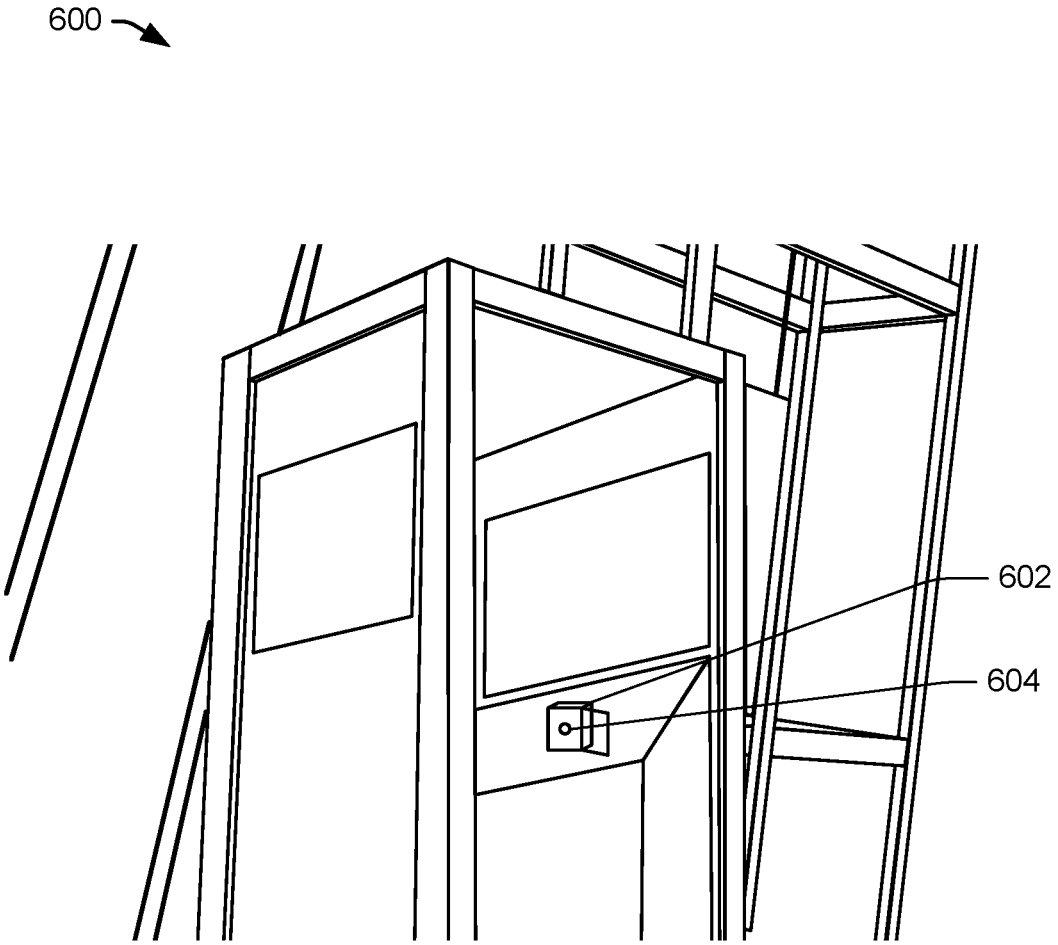
FIG. 6 illustrates an expanded view of a manual control center of the overtensioning fastening tool of the oil and gas rig of FIG. 2.

FIG. 6 illustrates an expanded view of a manual control center 600 of the oil and gas rig 200 of FIG. 2, including a manual activation component 602 of the overtensioning fastening tool 402. In some embodiments, the overtensioning fastening tool 402 includes a manual activation component 602 that may be located in the manual control center 600 of the oil and gas rig 200. The manual activation component 602 may also be located at any location where the manual activation component 602 can be wired to the overtensioning fastening tool 402 and provide ease of access for rig workers. The manual activation component 602 may be configured to receive a user input to activate the overtensioning fastening tool 402.

In some embodiments, the manual activation component 602 may include an activation button 604. The activation button 604 is configured to activate the overtensioning fastening tool 402 after the activation button 604 is manually pressed by a rig worker. The manual activation component 602 is configured to operate in conjunction with the overtensioning fastening tool 402 to ensure that the overtensioning fastening tool 402 is activated in the event of a technical issue. For example, if a component of the overtensioning fastening tool 402, such as the sensor, is damaged and does not detect a tension change resulting from an equipment failure, such as a cable breakage, that would otherwise trigger activation, a rig worker may press the activation button 604 of the manual activation component 602 and manually trigger the activation of the overtensioning fastening tool 402. This manual activation ensures that the overtensioning fastening tool 402 is activated in the event of an equipment failure or human error if the device has not been self-activated through other sensing techniques.

Figure 7:
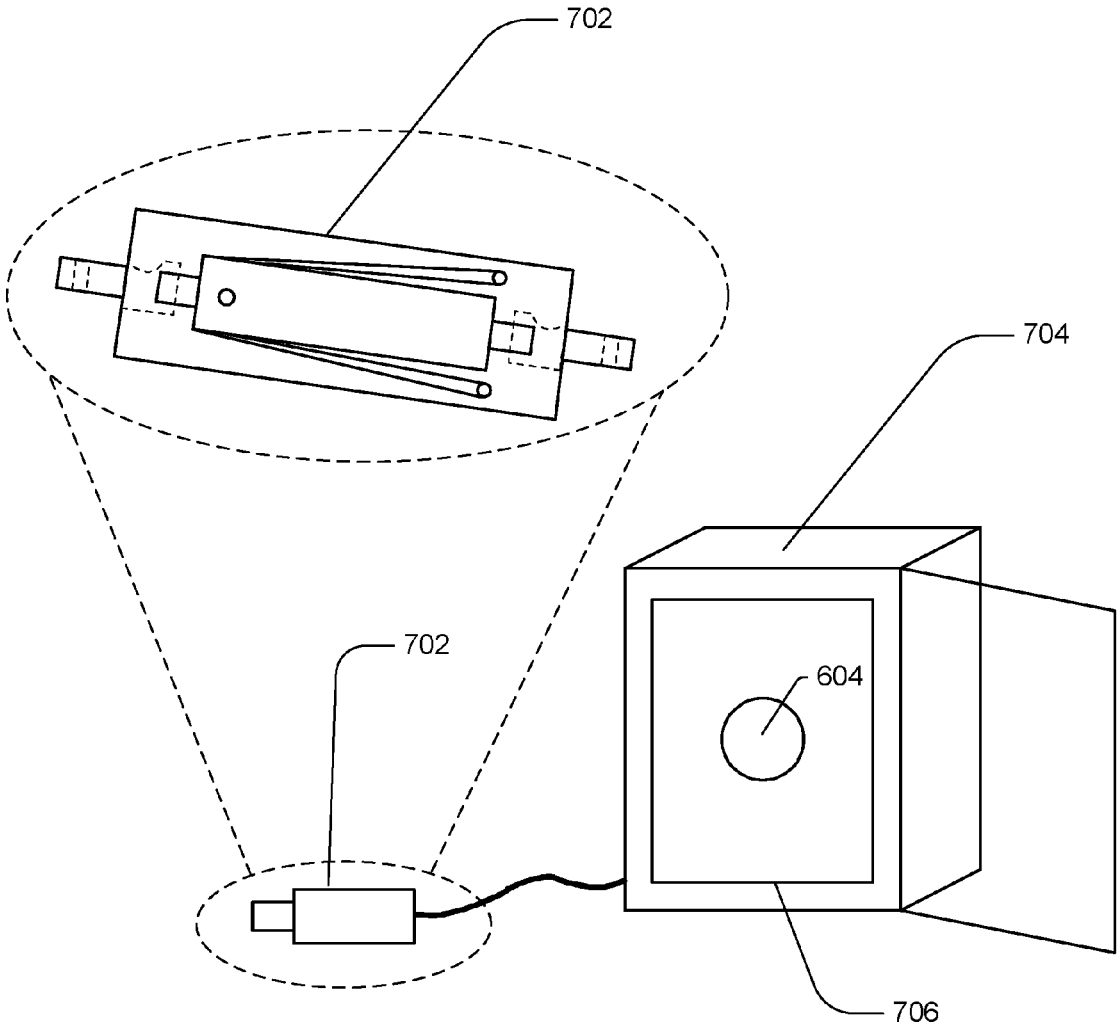
FIG. 7 illustrates an expanded view of components of the manual control center of FIG. 6, including an exploded view of a sensor connected to a manual activation component.

FIG. 7 illustrates components of the manual activation component 602 of FIG. 6, including an exploded view of the activation button 604 and the sensor 702 connected to the manual activation component 602. In some examples, the activation button 604 is housed in a manual activation housing 704 and may contain an activation panel 706 including the activation button 604, among other components. The manual activation housing 704 may be located in a manual control center of an oil and gas rig or may be located anywhere that is easily accessible by a rig worker and able to be attached to an overtensioning fastening tool.

In some implementations, the sensor 702 is configured to sense when the activation button 604 has been pressed and, in turn, utilize this sensing to activate the overtensioning fastening tool. The manual activation housing 704 may implement one or more components that transmit a signal, or some indication, to the sensor 702 that the activation button 604 has been pressed. The sensor 702 receives the signal or indication, processes the signal or indication, and transmits an activation event to the overtensioning fastening tool to trigger activation of the device at a wellhead.

Figure 8:
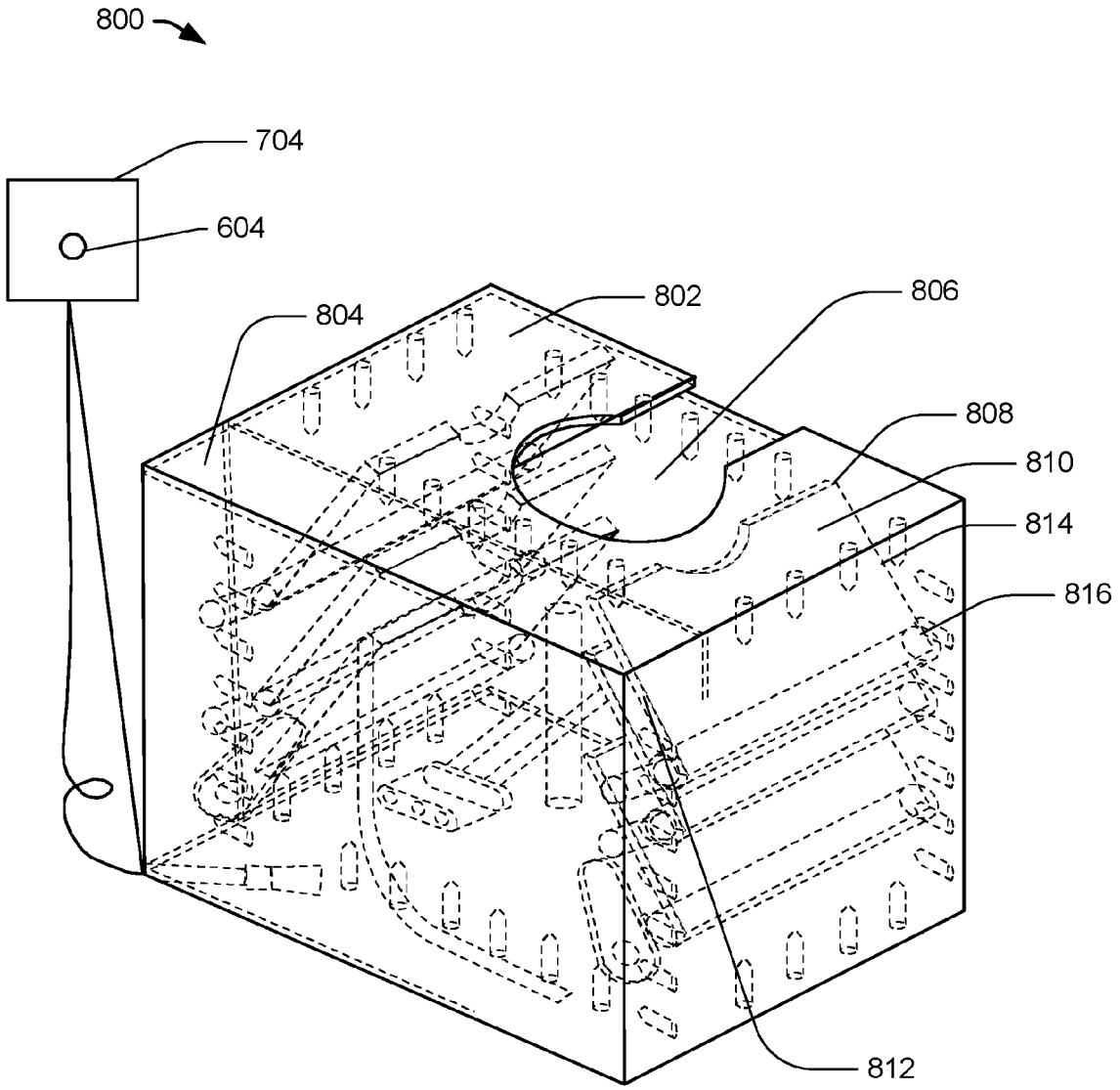
FIG. 8 illustrates a perspective view of an overtensioning fastening tool and the manual component of according to some implementations.
Figure 9:
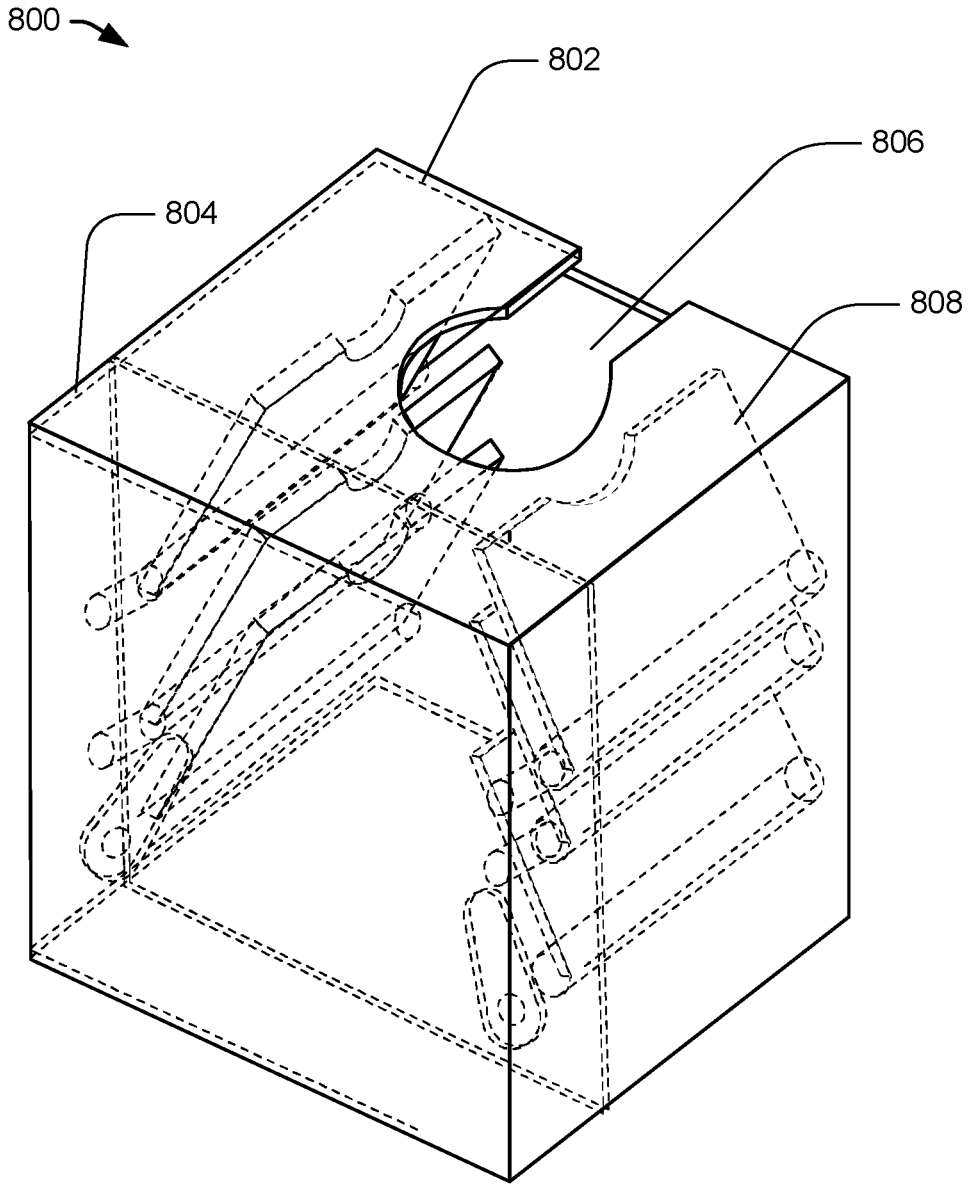
FIG. 9 illustrates another perspective view of the overtensioning fastening tool of FIG. 8.

FIGS. 8 and 9 illustrate perspective views of an example overtensioning fastening tool 800. The overtensioning fastening tool 800 may be the same or substantially the same as those implemented and described above with reference to FIGS. 2-7. In some examples, the overtensioning fastening tool 800 includes a primary enclosure 802 and a secondary enclosure 804 and is connected to manual activation component 704 having an activation button 604. The primary enclosure 802 houses one or more flapper components, or clamp components, and includes an opening 806 to allow well materials, such as production materials, tooling, and equipment, such as well tubing and cables, to run through the opening 806 into the wellbore. The overtensioning fastening tool 800 shown in FIG. 8 implements six flapper components. Each flapper component, such as illustrative flapper component 808, can include a flapper plate 810, a first flapper arm 812, a second flapper arm 814, and a flapper arm joint 816. The overtensioning fastening tool 800 may be located at the wellhead at the base of the wellbore, in some embodiments.

In some embodiments, in response to a rig worker pressing the activation button 604 of the manual activation component 704, the flapper components of the overtensioning fastening tool 800 engage and deploy to a closed position, as further illustrated and explained below with respect to FIGS. 10 and 11. When deployed to a closed position, the flapper components ensure that the cable and well tubing running through the opening 806 are controlled to prevent loss into the wellbore.

In some examples, each flapper plate, such as flapper plate 810, may be shaped to include a curvature designed to fit around the outside surface of a production line section, such as well tubing. The curvature may include additional gripping features along the exterior to ensure that, when in the closed position, the flapper plate is exerting a sufficient force to the outside of the well tubing to prevent migration. For example, the additional gripping features may include studs or spikes that extend from a surface of the curvature. FIG. 9 represents an additional perspective view of the overtensioning fastening tool 800.

Figure 10:
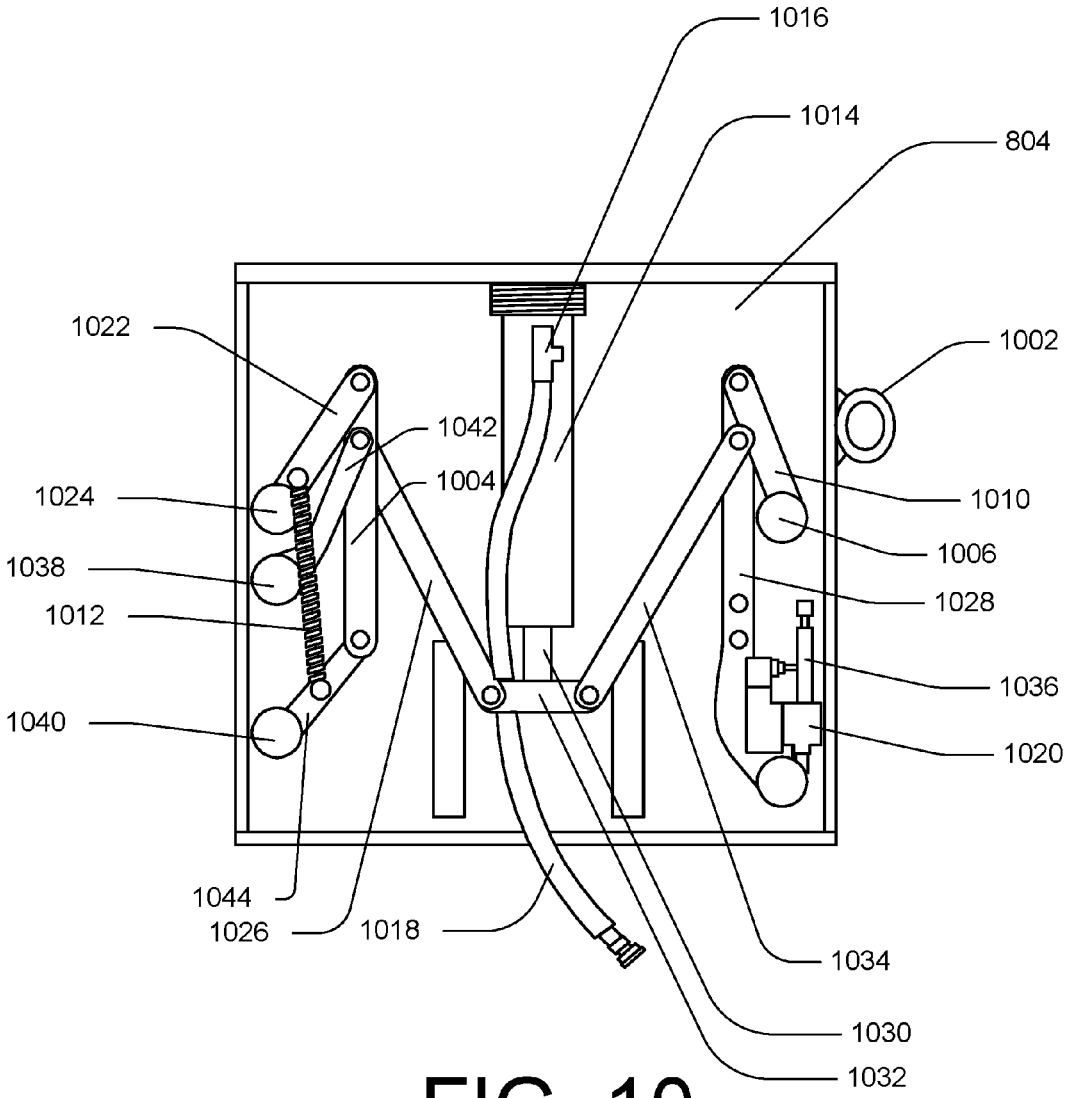
FIG. 10 illustrates a side view of the interior of the secondary enclosure of the overtensioning fastening tool of FIGS. 8 and 9.

FIG. 10 illustrates a side view of the interior of the secondary enclosure 804 of the overtensioning fastening tool 800 of FIGS. 8 and 9. The illustrated secondary enclosure 804 includes a lifting holder 1002, positioned on an external surface, a hydraulic deployment system, an electric deployment system, and associated components. However, additional components, arrangements, and quantities of each component may vary according to the desired drilling and production operations.

In some implementations, the lifting holder 1002 is configured to assist in the placement of the overtensioning fastening tool 800 onto the wellhead of an oil and gas rig. For example, a cable pulley system employed by the oil and gas rig may attach a hook, or other fastener, to the opening of the lifting holder 1002 to aid in lifting and positioning the overtensioning fastening tool 800 at the desired location at the wellhead. Since the overtensioning fastening tool 800 may be very heavy, or require placement in a location that is not easily accessible by rig workers, the lifting holder 1002 may assist in the ease and accuracy of placement.

In some embodiments, each flapper component of the primary enclosure is connected to the hydraulic deployment system and the electric deployment system via a flapper connector and a connector joint. For example, the flapper connector 1022 is attached to the connector joint 1024 at one end and attached to a flapper component (not shown), housed in the primary enclosure, on the other end. Upon activation, the flapper connector 1022 and the connector joint 1024 migrate to deploy the flapper component to the closed position.

In further embodiments, the overtensioning fastening tool 800 includes one or more flapper springs configured to hold the flapper components in the open position until deployed to a closed position. For example, flapper spring 1012 holds the flapper connectors 1022, 1042, 1044 and the attached connector joints 1024, 1038, 1040, located on one side of the overtensioning fastening tool 800, in an open position as shown in FIG. 10. Upon activation of the overtensioning fastening tool 800, the connectors 1022, 1042, 1044 migrate to deploy the flapper components of the primary enclosure to a closed position and the flapper spring 1012 contracts to a flattened state.

In still further embodiments, the overtensioning fastening tool 800 may implement an electric deployment system. The electric deployment system including the electric valve 1020 to work in conjunction with a manual activation component, such as manual activation component 602 and associated activation button 604 described above with respect to FIG. 6. In some examples, when an activation button of a manual activation component is pressed, the overtensioning fastening tool 800 is activated and the electric valve 1020 is opened. Upon opening of the electric valve 1020, gas is released to create pressure that is applied against an electric valve shaft 1036, or piston. The applied pressure causes the electric valve shaft 1036 to migrate and to apply a force onto an electric valve arm 1028. The electric valve arm 1028 is attached, at a first end, to the electric valve shaft 1036 and attached, at a second end, to the flapper connector 1010. The flapper connector 1010 is also attached to a flapper connector (not shown) housed in the primary enclosure. The force applied to the electric valve arm 1028, by the electric valve shaft 1036, causes the attached flapper connector 1010 to rotate along the connector joint 1006 to deploy the attached flapper connector (not shown) to the closed position.

In some implementations, once in the closed position, the flapper component attached to the flapper connector 1010, along with other flapper components of the overtensioning fastening tool 800, grip the well tubing and/or cable and ensure that they are not released into the wellbore. For example, a flapper plate (not shown) of the flapper component, when deployed in the closed position, may assert a force onto the sides of a well tubing to ensure that the well tubing cannot migrate. The flapper component may also include an additional flapper grip (not shown), in some examples, that protrudes from the flapper plate and applies a gripping force onto a cable to ensure that the cable does not migrate, even in the event of a well tubing migration.

In some implementations, the overtensioning fastening tool 800 includes a hydraulic cylinder 1014, check valve 1016, hose 1018, hydraulic shaft 1030, hydraulic cylinder shaft stop 1032, hydraulic arm 1026, and intermediate arm 1004. The hydraulic cylinder 1014 is configured to operate along with a hydraulic deployment system, where water or other fluid is supplied through the hose 1018. In some examples, an oil and gas rig implements a sensor configured to operate in conjunction with the overtensioning fastening tool 800, such as the sensor 504 described above with respect to FIG. 5. The sensor may be configured to detect the tension of cables employed in the oil and gas rig. The sensor may also be programmed with a pre-set tension range or tension threshold value at which each particular cable should remain. The sensor monitors the tension of a cable and is configured to detect changes in the tension of the cable that deviate more than a certain amount from the pre-set tension, which may indicate an equipment failure or human error resulting in potentially hazardous conditions to the operation of the oil and gas rig. In response to detecting a deviation, the sensor may activate the overtensioning fastening tool 800 to ensure control of the cable is maintained.

In further implementations, when the sensor activates the overtensioning fastening tool 800, the hydraulic deployment system engages. In some embodiments, engaging the hydraulic deployment system causes the hose 1018 to supply enough water to apply a pressure to a hydraulic shaft 1030 of the hydraulic cylinder 1014 to cause a migration. The migration subsequently causes the flapper connectors of the overtensioning fastening tool 800 to migrate and deploy to the closed position.

For example, the applied pressure causes the hydraulic shaft 1030 to migrate and apply a force onto the hydraulic cylinder shaft stop 1032. The force applied to the hydraulic cylinder shaft stop 1032 causes the hydraulic arm 1026, attached to the hydraulic cylinder shaft stop 1032, and the intermediate arm 1004, attached to the hydraulic arm 1026, to migrate. The migration of the hydraulic arm 1026 and the intermediate arm 1004 subsequently causes the flapper connectors 1022, 1042, 1044 to rotate along the connector joints 1024, 1038, 1040 to deploy flapper components (not shown) attached to the flapper connectors 1022, 1042, 1044 to the closed position. A secondary hydraulic arm 1034 operates similarly with respect to flapper component 1010. Additional hydraulic arms may be required dependent on the number and arrangement of the flapper components.

In some implementations, once in the closed position, the attached flapper components attached to flapper connectors 1022, 1042, 1044, along with other flapper components of the overtensioning fastening tool 800, grip the well tubing and/or cable and ensure that they are not released into the wellbore. For example, a flapper plate (not shown) of the flapper component, when deployed in the closed position, may assert a force onto the sides of a well tubing to ensure that the well tubing cannot migrate. The flapper component may also include an additional flapper grip (not shown), in some examples, that protrudes from the flapper plate and applies a gripping force onto a cable to ensure that the cable does not migrate, even in the event of a well tubing migration.

In some examples, the check valve 1016 is configured to ensure that the hydraulic cylinder 1014 does not lose the force applied to the hydraulic arm 1026 and the attached flapper connectors 1022, 1042, 1044 remain rotated to the migrated, or closed, position. The check valve 1016 ensures the hydraulic deployment system maintains its function so that the well tubing and/or cable does not migrate and that no product is released from the wellbore.

In some examples, each flapper plate, may be shaped to include a curvature designed to fit around the exterior of a well tubing section that runs through the primary enclosure of the overtensioning fastening tool 800. The curvature may include additional gripping features along the exterior to ensure that, when in the closed position, the flapper plate is exerting a sufficient force to the outside of the well tubing to prevent migration.

Figure 11:
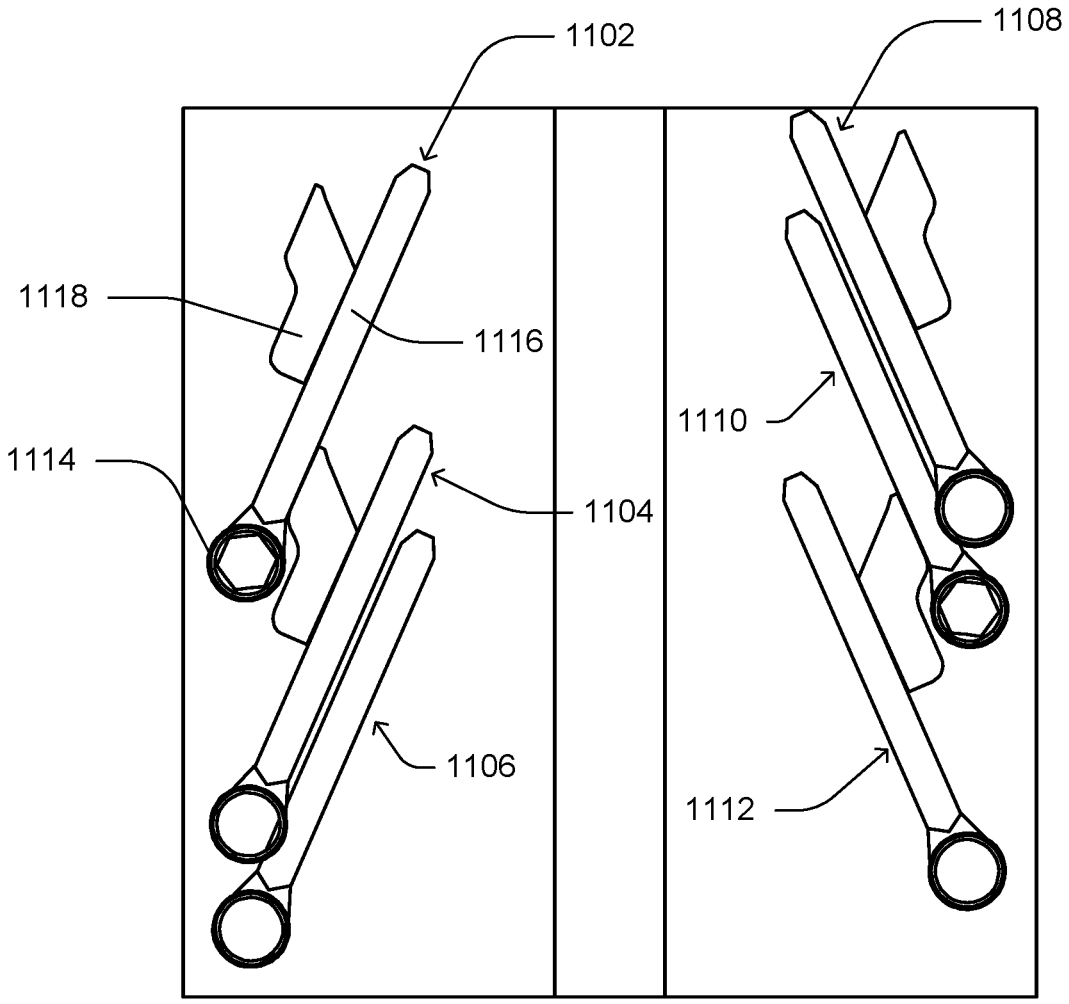
FIG. 11 illustrates a side view of the interior of the primary enclosure of the overtensioning fastening tool of FIGS. 8 and 9 depicting flapper components in an open formation.

FIG. 11 illustrates a side view of the interior of the primary enclosure 802 of overtensioning fastening tool 800 of FIGS. 8 and 9, further depicting flapper components in an open formation. Each flapper component 1102, 1104, 1106, 1108, 1110, 1112 includes a flapper plate (not shown), one or more flapper arms, a flapper joint, and may further include an additional flapper grip. For example, in the illustrated example, the illustrative flapper component 1102 includes a flapper joint 1114, a flapper arm 1116, a flapper plate (not shown), and a flapper grip 1118.

In some embodiments, the flapper grip 1118 may be attached to the edge of the flapper plate and may include gripping devices such as ridges, spikes, or other protrusions. The gripping devices are configured to maintain grip and control of a cable even in the event that control of the well tubing is lost when the flapper components 1102, 1104, 1106, 1108, 1110, 1112 are deployed to the closed position. The flapper components 1102, 1104, 1106, 1108, 1110, 1112 remain in the open position until the overtensioning fastening tool 800 is activated and the flapper components 1102, 1104, 1106, 1108, 1110, 1112 are deployed to the close position as described above.

Figure 12:
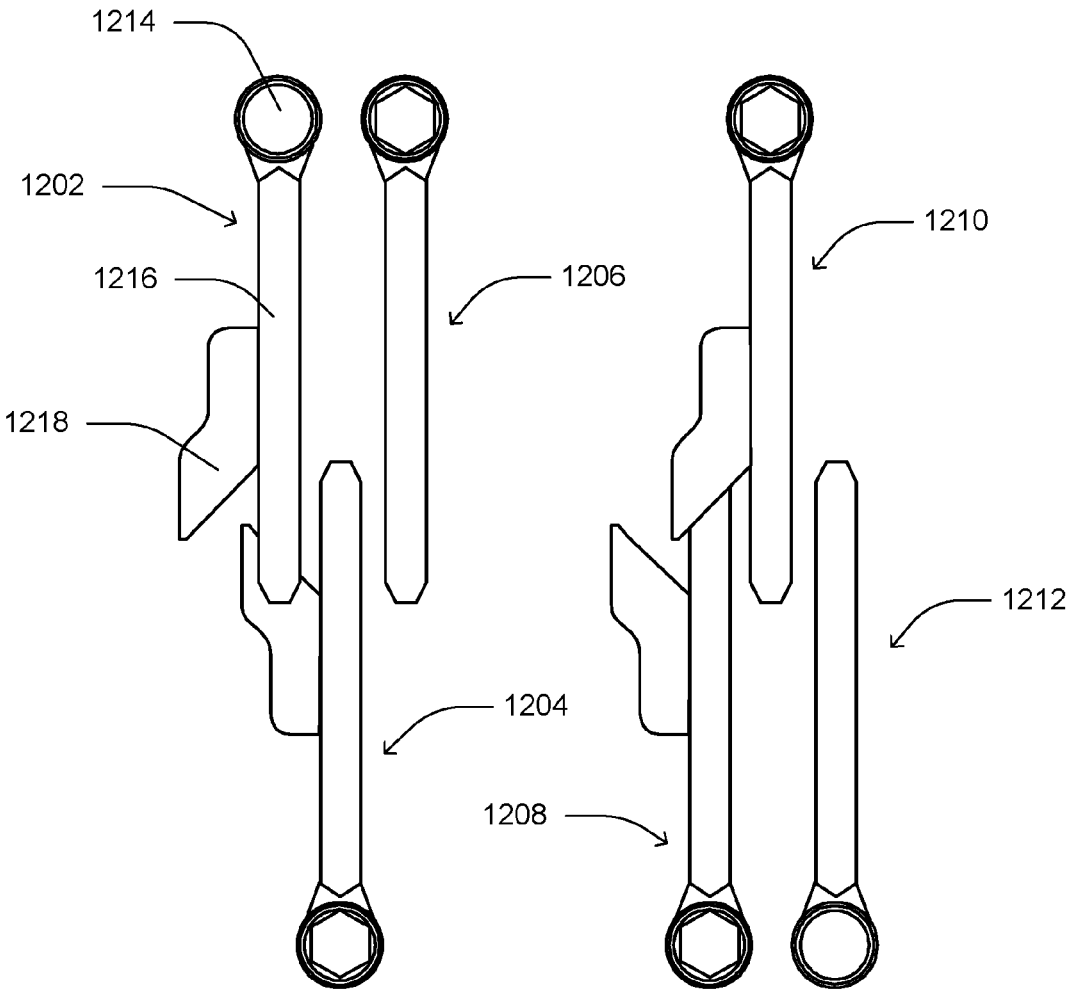
FIG. 12 illustrates a side view of flapper components of the overtensioning fastening tool of FIGS. 8 and 9 in a closed formation according to some implementations.

FIG. 12 illustrates a side view of flapper components of the overtensioning fastening tool 800 of FIGS. 8 and 9 deployed to a closed formation after activation. Each flapper component 1202, 1204, 1206, 1208, 1210, 1212 includes a flapper plate (not shown), one or more flapper arms, a flapper joint, and may further include a flapper grip. For example, in the illustrated example, the illustrative flapper component 1202 includes a flapper joint 1214, a flapper arm 1216, a flapper plate (not shown), and a flapper grip 1218.

In some examples, once deployed to the closed formation, the flapper components 1202, 1204, 1206, 1208, 1210, 1212 assert a force onto the well tubing and/or cable to prevent migration. For example, the flapper plate of flapper component 1202 may assert a force onto the sides of the well tubing to ensure that the well tubing is not released into the wellbore.

In some embodiments, the flapper grip 1218 may be attached to the edge of the flapper plate and may include gripping devices such as ridges, spikes, or other protrusions. The gripping devices are configured to maintain grip and control of a cable even in the event that control of the well tubing is lost. In addition, in some examples, each flapper plate, may be shaped to include a curvature designed to fit around the outside of a well tubing section. The curvature may include additional gripping features along the exterior to ensure that, when in the closed position, the flapper plate is exerting a sufficient force to the outside of the well tubing to prevent migration.

Figure 13:
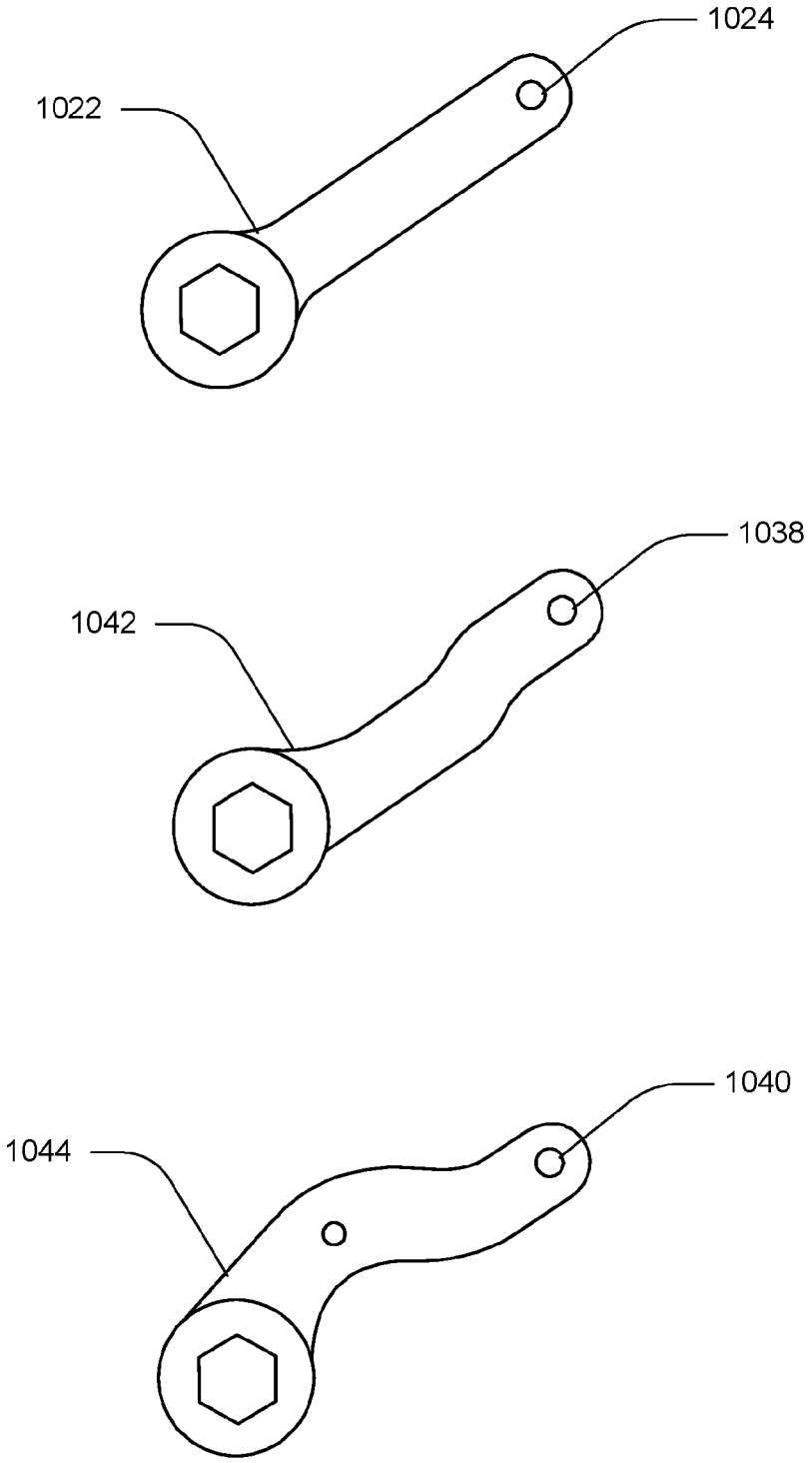
FIG. 13 illustrates an expanded view of the flapper connectors and connector joint configurations of FIG. 10.

FIG. 13 illustrates an expanded view of the flapper connectors 1022, 1042, 1044 and connector joints 1024, 1038, 1040, of FIG. 10. As described above, each flapper component of the main primary enclosure is connected to the hydraulic deployment system and the electric deployment system of the overtensioning fastening tool via a flapper connector and a connector joint. The flapper connector and flapper joint are configured to operate in conjunction with the hydraulic deployment system and electric deployment system to deploy the flapper components upon activation. Different shapes and configurations of the flapper connectors 1022, 1042, 1044, as shown, may be implemented in the same overtensioning fastening tool. If different shapes and configurations are implemented substantially simultaneously, the connector joints 1024, 1038, 1040 are arranged and configured so that they do not physically interfere with each other during the opening and closing of their respective flapper components. For example, the flapper connector 1022 is substantially linear, the flapper connector 1042 includes a slight bend in a first direction, and the flapper connector 1044 may include a large bend or a bend having a greater radius than the flapper 1042 in a second direction, the second direction opposite the first direction.

Figure 14:
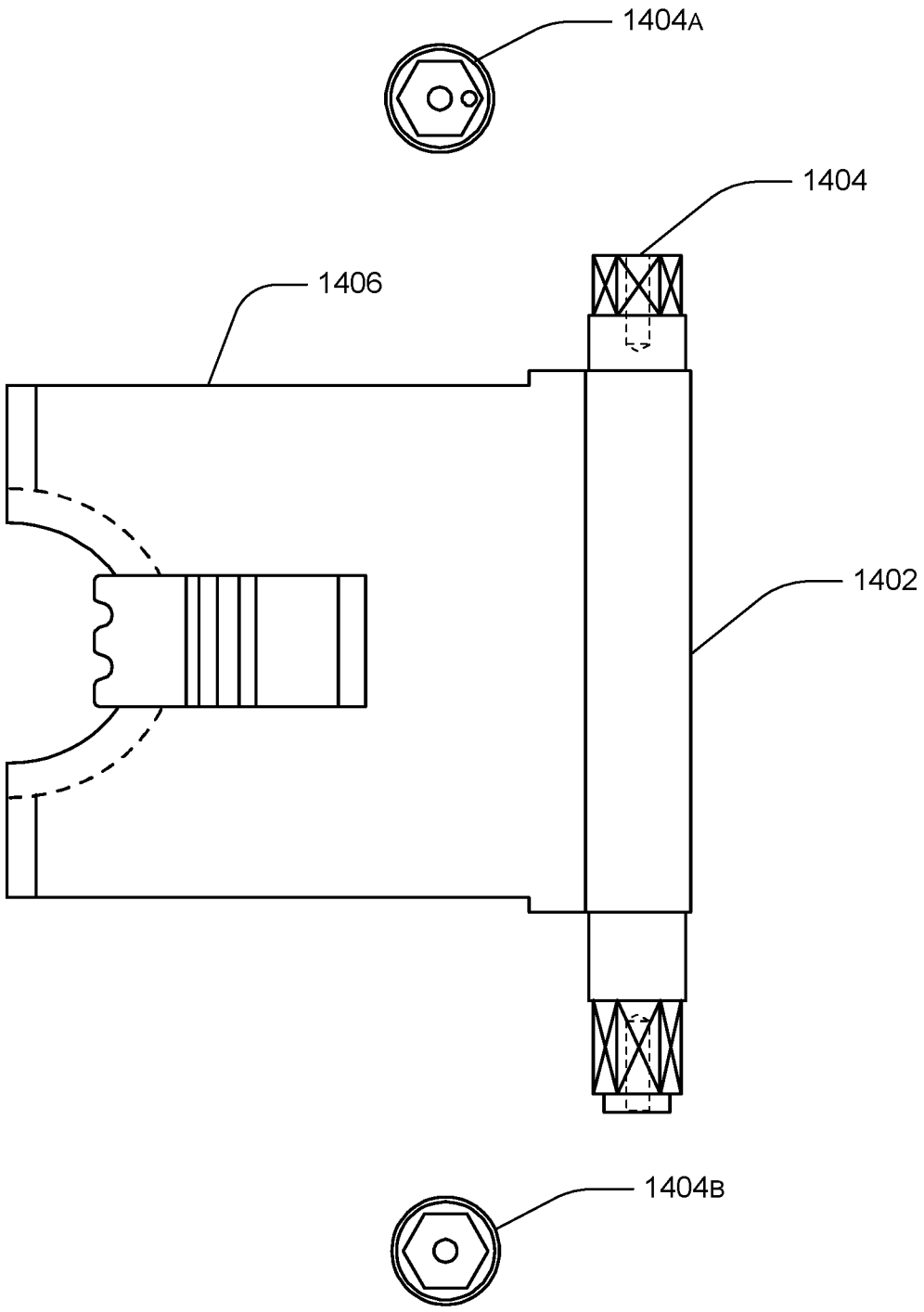
FIG. 14 illustrates a top view an exemplary flapper component and side view of a flapper arm joint of the flapper component of an overtensioning fastening tool according to some implementations.
Figure 15:
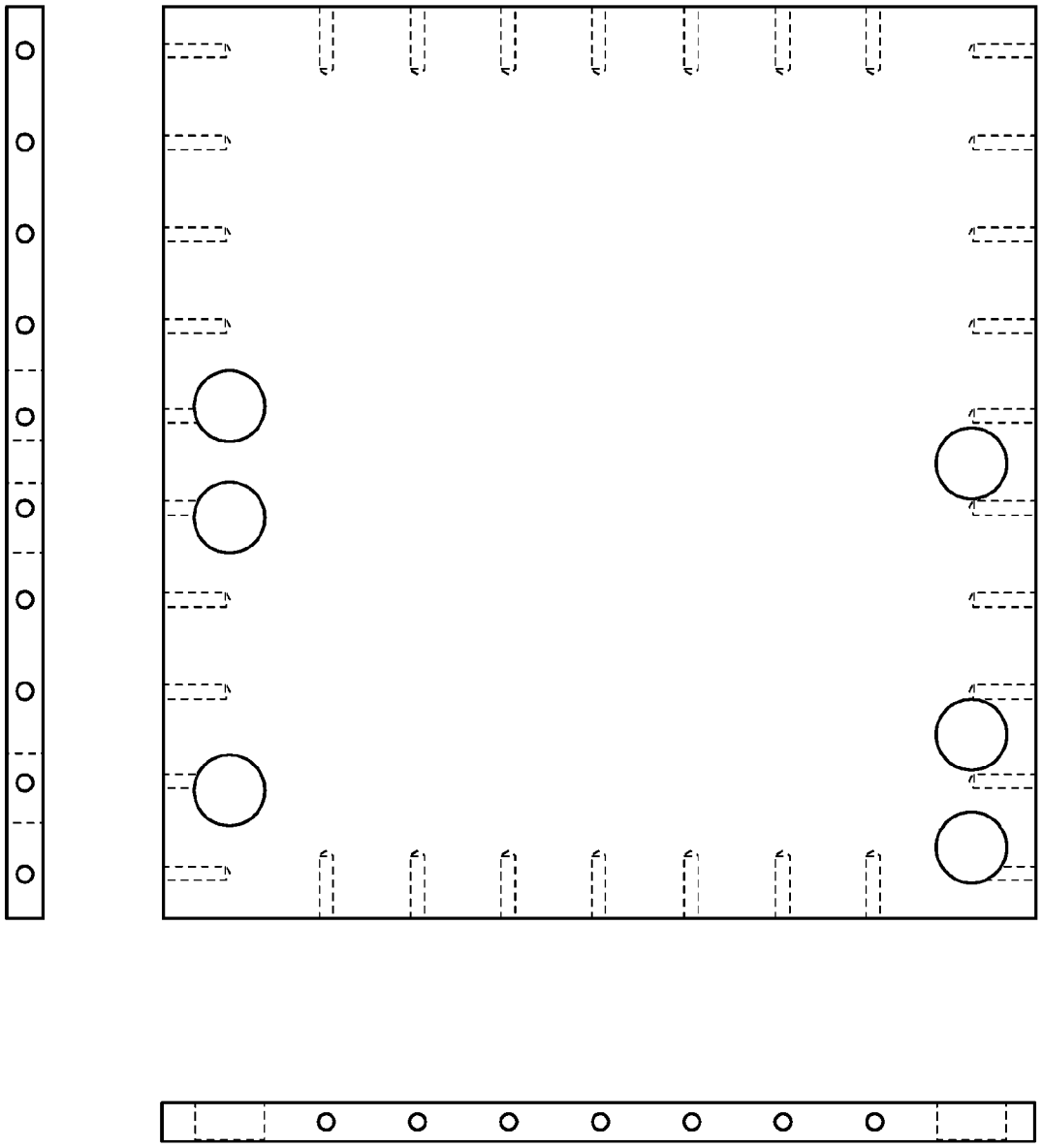
FIG. 15 illustrates a rear view of a flapper plate of a flapper component of FIG. 12 according to some implementations
Figure 16:
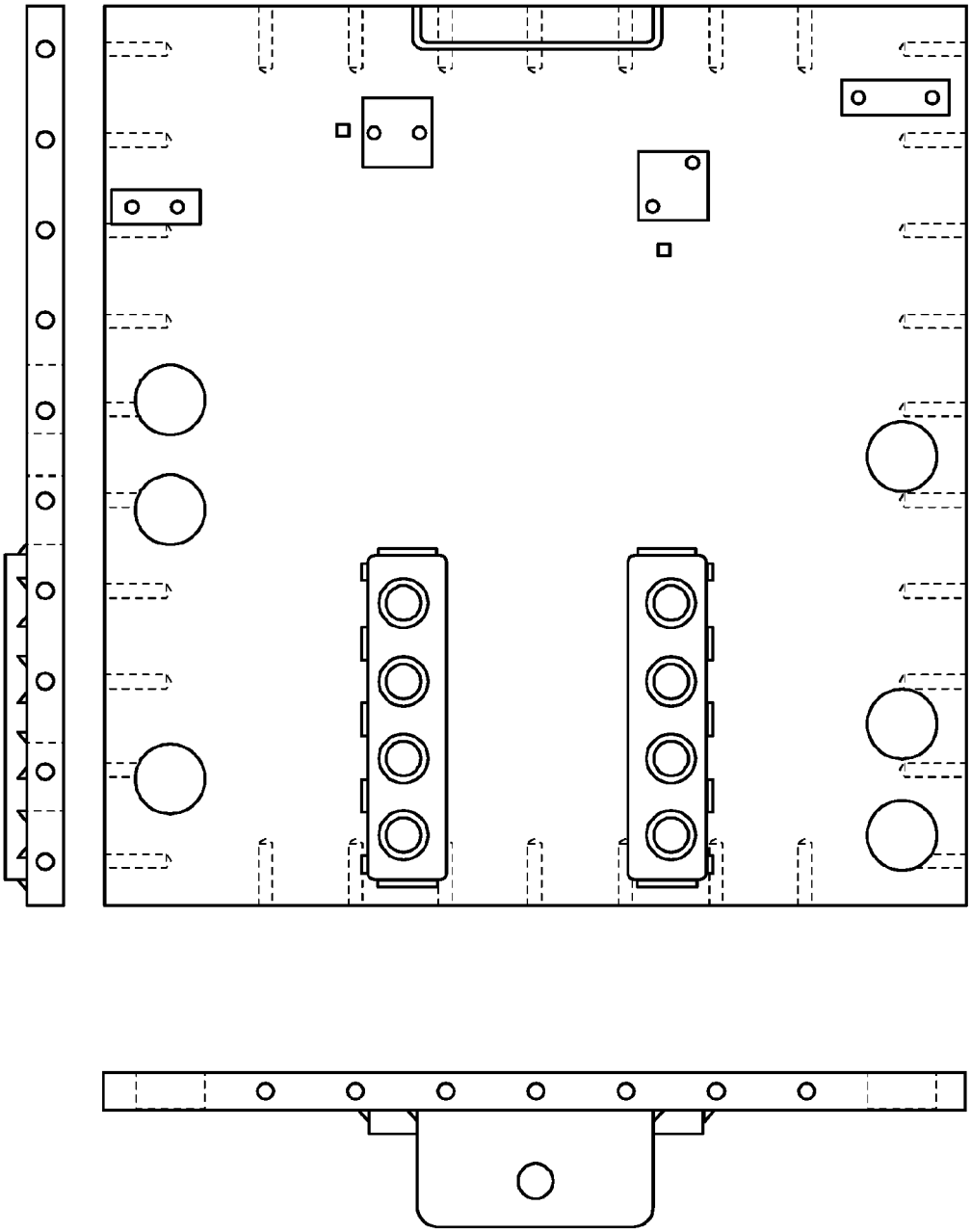
FIG. 16 illustrates a front view of a flapper plate of a flapper component of FIG. 12 according to some implementations.
Figure 17:
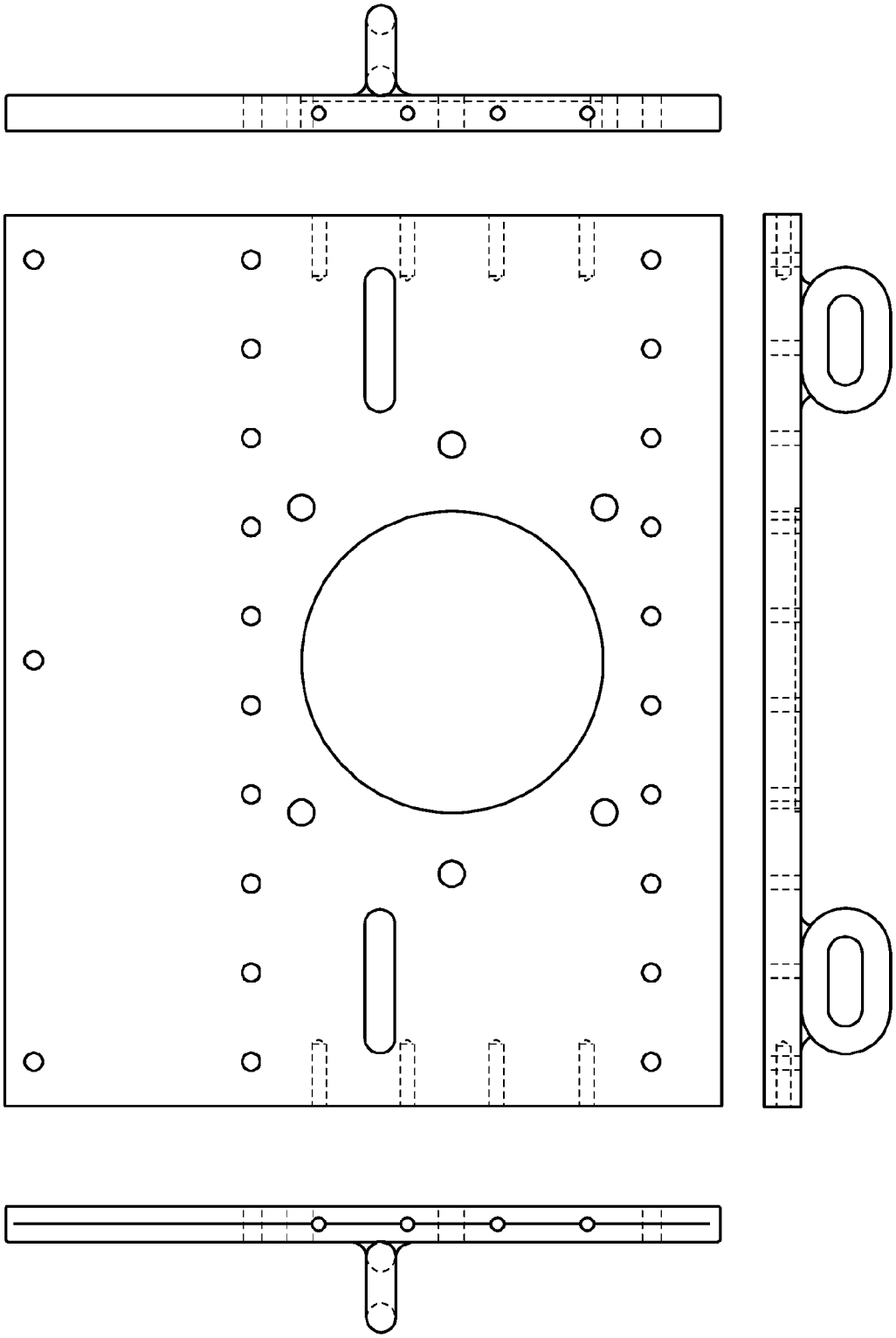
FIG. 17 illustrates a side view of a flapper plate of a flapper component of FIG. 12 according to some implementations.
Figure 18:
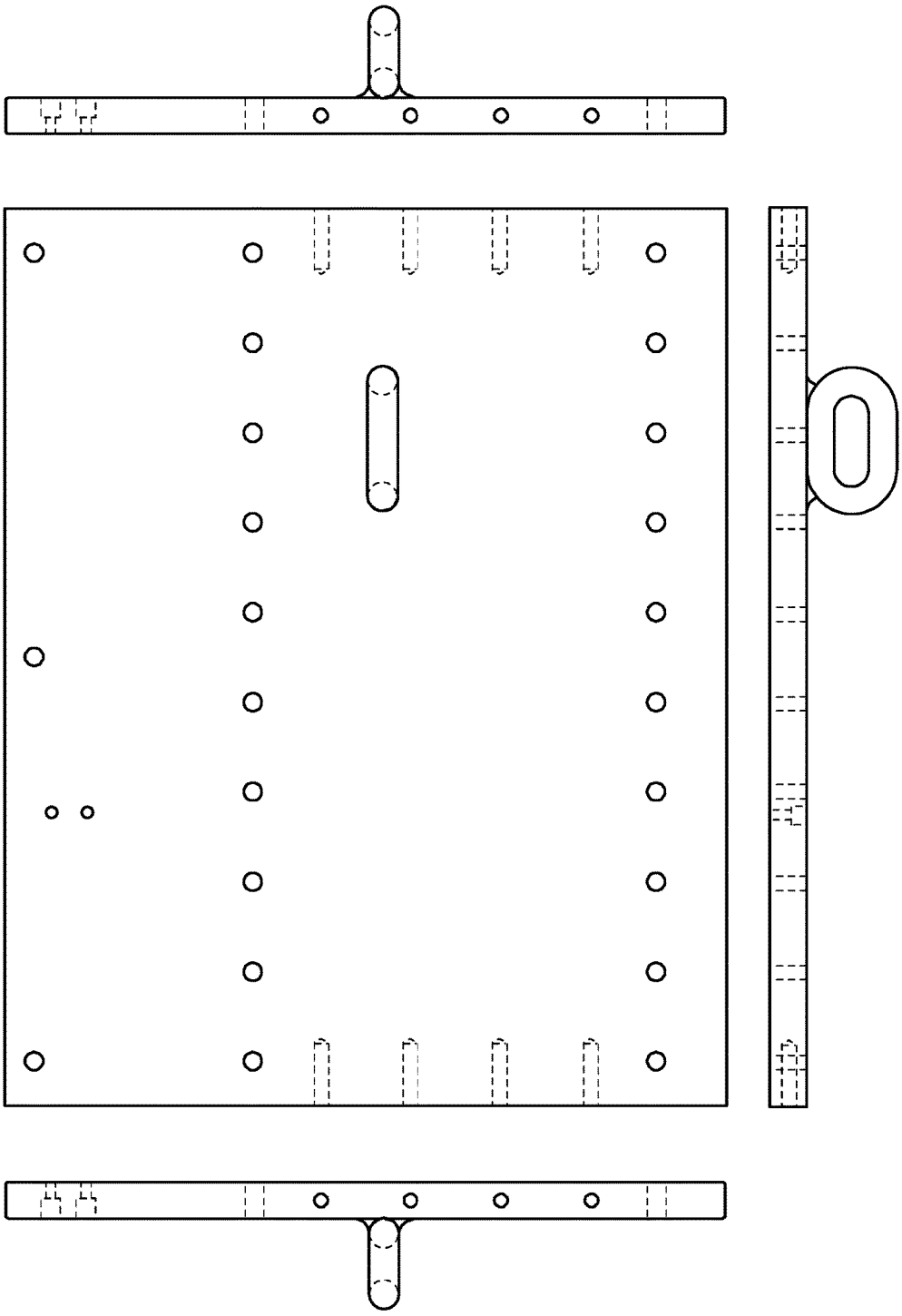
FIG. 18 illustrates a side view of a flapper plate of a flapper component of FIG. 12 according to some implementations.
Figure 19:
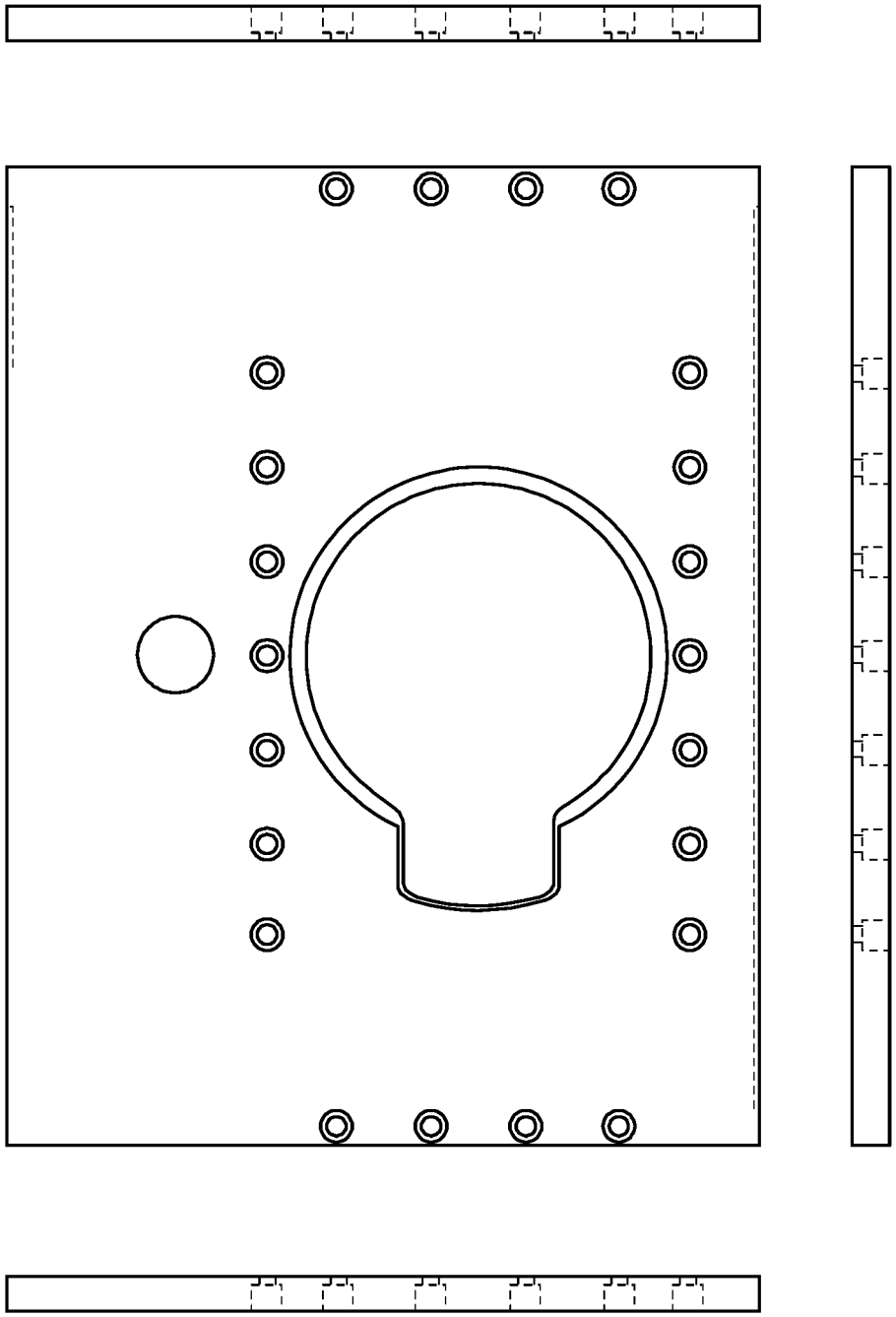
FIG. 19 illustrates a top view of a flapper plate of a flapper component of FIG. 12 according to some implementations.
Figure 20:
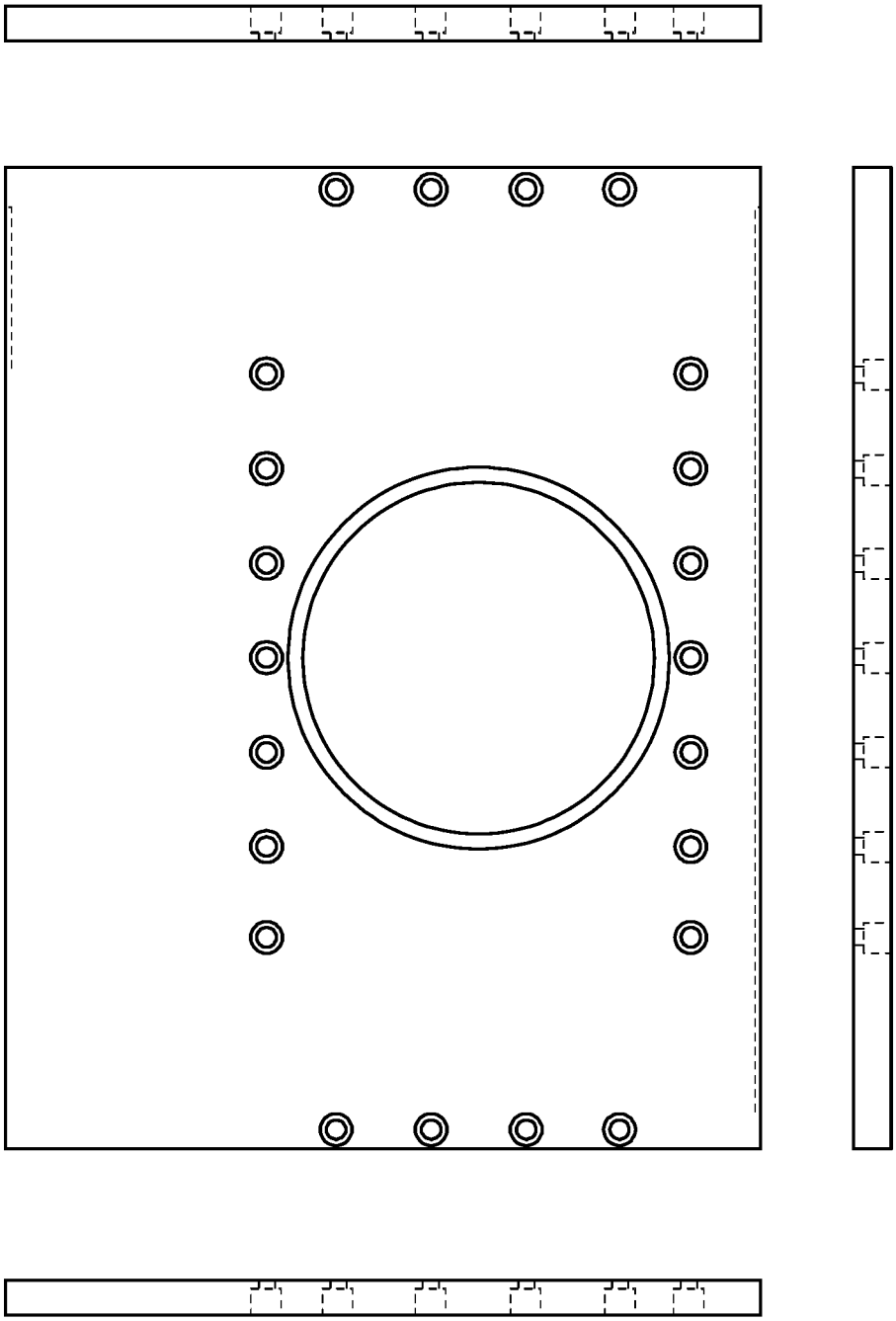
FIG. 20 illustrates a bottom view of a flapper plate of a flapper component of FIG. 12 according to some implementations.

FIG. 14 illustrates a top view an exemplary flapper component 1402 and side view of a flapper joint 1404 of an overtensioning fastening tool. The flapper joint 1404 is connected to a flapper plate 1406 by one or more flapper arms (not shown). The first flapper joint side view 1404*a* and the second flapper joint side view 1404*b* show the interior mechanical structure of the flapper joint 1404, configured to allow the flapper component 1402 to transition between the closed and open positions.

FIGS. 15-20 illustrate various views of exemplary flapper plates of a flapper component. Different flapper plates, and combinations thereof, may be implemented depending on the type of well, the type of formation, the product to be extracted, and other various oil and gas drilling and production considerations. The various flapper plates implemented in an overtensioning fastening tool may be configured to avoid physical interference with each other during the opening and closing of their respective flapper component(s). Each flapper plate may also include a curvature to allow for equipment and tooling, such as well tubing and cables, to pass through the device and into the wellbore.

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. A tool comprising:

a first enclosure, the first enclosure including:

a first flapper component, the first flapper component including a first flapper plate, a first flapper arm, a first flapper joint, and a first gripping component extending upward from a top surface of the first flapper plate, the first gripping component extending outward past a front surface of the first flapper plate; and a cover component, the cover component including an opening to allow production equipment to enter the first enclosure; and a second enclosure, the second enclosure located adjacent to the first enclosure and including:

a hydraulic flapper deployment system, the hydraulic flapper deployment system attached to the flapper component; and an electric flapper deployment system, the electric flapper deployment system attached to the flapper component.

2. The tool of claim 1, further comprising a sensor, wherein the sensor is programmed with a tension value range and configured to monitor tension of the production equipment.

3. The tool of claim 2, wherein the sensor transmits an activation event to the hydraulic flapper deployment system in response to detecting a deviation from the tension value range.

4. The tool of claim 3, wherein the hydraulic flapper deployment system is configured to deploy the first flapper component to a closed position in response to the activation event.

5. The tool of claim 1, further including a manual activation component configured to receive a user input.

6. The tool of claim 5, wherein the manual activation component transmits an activation event to the electric flapper deployment system in response to the user input.

7. The tool of claim 6, wherein the electric flapper deployment system is configured to deploy the first flapper component to a closed position in response to the activation event.

8. The tool of claim 1, wherein:

the first enclosure includes a second flapper component, the second flapper component including a second flapper plate, a second flapper arm, a second flapper joint, and a second gripping extending upward from a top surface of the second flapper plate, the second gripping component extending outward past a front surface of the second flapper plate, the second flapper component coupled to a first side of the first enclosure by the second flapper arm; and the first flapper component coupled to a second side of the first enclosure by the first flapper arm, the second side of the first enclosure opposite the first side of the first enclosure.

9. A device comprising:

an enclosure with a first surface and a second surface opposite the first surface;

a first flapper plate coupled to the first surface of the enclosure via a first flapper arm and a first flapper joint, the first flapper plate to apply a first pressure to a cable or tubing;

a second flapper plate coupled to the first surface of the enclosure via a second flapper arm and a second flapper joint, the second flapper plate to apply a second pressure to the cable or tubing;

a third flapper plate coupled to the second surface of the enclosure via a third flapper arm and a third flapper joint, the third flapper plate to apply a first pressure to the cable or tubing;

a sensor configured to detect a tension event; and a deployment system to activate the first flapper plate, the second flapper plate, and the third flapper plate in response to the sensor detecting the tension event.

10. The device of claim 9, wherein the deployment system is an electric deployment system.

11. The device of claim 9, wherein the deployment system is a hydraulic deployment system.

12. The device of claim 9, further comprising a fourth flapper plate coupled to the second surface of the enclosure via a fourth flapper arm and a fourth flapper joint, the fourth flapper plate to apply a fourth pressure to the cable or tubing.

13. The device of claim 12, further comprising a first gripping component extending upward from the first flapper plate and a second gripping component extending upward from the second flapper plate, the first gripping component extending outward past a front surface of the first flapper plate and the second gripping component extending outward past a front surface of the second flapper plate.

14. The device of claim 13, further comprising a third gripping component extending upward from the third flapper plate, the third gripping component extending outward past a front surface of the third flapper plate.

15. A device comprising:

a tool, the tool comprising:

a first flapper component, the first flapper component including a first flapper plate, a first flapper arm, and a first flapper joint, the first flapper arm including a first bend in a first direction;

a second flapper component, the second flapper component including a flapper plate, a second flapper arm, and a second flapper joint, the second flapper arm including a second bend in a second direction and a third bend in the first direction, the second direction opposite the first direction;

a hydraulic flapper deployment system, the flapper hydraulic operation system attached to the flapper component; and a sensor, the sensor configured to activate the flapper hydraulic deployment system of the tool in response to a tension event.

16. The device of claim 15, further comprising an electric flapper deployment system, the electric flapper deployment system attached to the first flapper component and the second flapper component.

17. The device of claim 16, further comprising a manual activation component, the manual activation component configured to activate the electric flapper deployment system of the tool in response to a user input.

18. The device of claim 15, wherein the first flapper component further includes a gripping component, the gripping component extending from an external surface of the first flapper plate.

19. The device of claim 15, wherein the hydraulic flapper deployment system is configured to deploy the flapper component to a closed position in response to the tension event.

20. The device of claim 17, wherein the electric flapper deployment system is configured to deploy the first flapper component to a closed position in response to the user input.

* * * * *